US007827964B2

(12) United States Patent
Chern et al.

(10) Patent No.: US 7,827,964 B2
(45) Date of Patent: Nov. 9, 2010

(54) FUEL INJECTION SYSTEM FOR INTERNAL COMBUSTION ENGINE WITH INJECTOR ISOLATOR

(75) Inventors: Yitzong Chern, Troy, MI (US); Deanna Hoffman, Ann Arbor, MI (US); Mario Joseph Felice, Dearborn Heights, MI (US); Steven Homco, Canton, MI (US); Joseph Basmaji, Waterford, MI (US)

(73) Assignee: Ford Global Technologies, Dearborn, MI (US)

( * ) Notice: Subject to any disclaimer, the term of this patent is extended or adjusted under 35 U.S.C. 154(b) by 7 days.

(21) Appl. No.: 12/412,574

(22) Filed: Mar. 27, 2009

(65) Prior Publication Data

US 2010/0175668 A1 Jul. 15, 2010

Related U.S. Application Data

(60) Provisional application No. 61/144,513, filed on Jan. 14, 2009.

(51) Int. Cl.
*F02M 55/02* (2006.01)
*F02F 11/00* (2006.01)

(52) U.S. Cl. ..... 123/470; 277/591; 277/594; 277/596

(58) Field of Classification Search ..... 123/470; 277/590–654
See application file for complete search history.

(56) References Cited

U.S. PATENT DOCUMENTS 2,729,482 A * 1/1956 Kosatka ..... 277/573
3,038,456 A * 6/1962 Dreisin ..... 123/470
3,595,588 A * 7/1971 Rode ..... 277/650
3,770,181 A * 11/1973 Stahl ..... 277/404
3,841,277 A * 10/1974 Schafer ..... 123/470
3,857,574 A * 12/1974 Artzer ..... 277/606
3,941,109 A * 3/1976 Schmid ..... 123/470
4,528,959 A * 7/1985 Hauser, Jr. ..... 123/470
5,129,658 A * 7/1992 Berton et al. ..... 277/591
5,131,667 A * 7/1992 Mong et al. ..... 277/613
5,835,546 A * 11/1998 Stapleton ..... 376/203
6,334,433 B1 * 1/2002 Sumida et al. ..... 123/470
6,427,667 B1 * 8/2002 Kato ..... 123/470
6,460,512 B1 * 10/2002 Serio ..... 123/470
6,481,421 B1 * 11/2002 Reiter ..... 123/470
6,830,036 B2 * 12/2004 Okajima et al. ..... 123/470
6,840,226 B2 * 1/2005 Hans ..... 123/470
6,866,026 B2 * 3/2005 Mickelson ..... 123/470
6,899,087 B2 * 5/2005 Norgauer ..... 123/470
6,899,341 B2 * 5/2005 Neumaier ..... 277/647
7,004,476 B2 * 2/2006 Nakayama et al. ..... 277/591
7,104,257 B2 * 9/2006 Kawamoto et al. ..... 123/470
7,281,521 B2 * 10/2007 Neumaier ..... 123/470

(Continued)

*Primary Examiner*—Thomas N Moulis
(74) *Attorney, Agent, or Firm*—Jerome R. Drouillard; Julia Voutyras

(57) ABSTRACT

A fuel injection system for an internal combustion engine includes a fuel injector pocket, formed within a cylinder head, for housing an injector which sprays fuel into a combustion chamber defined by the cylinder head and a piston crown. The injector is mounted with an isolator which is loaded at a lower, elastic rate during lower power operation, with the elastic load element being stacked solid and subject to higher rate column loading during high power operation of the engine and injection system. The isolator controls unwanted injector ticking noise, while protecting the integrity of the injector's tip seal.

15 Claims, 6 Drawing Sheets

U.S. PATENT DOCUMENTS 7,293,550 B2 * 11/2007 Beardmore ..... 123/470
7,513,242 B2 * 4/2009 Morris ..... 123/470
7,591,246 B2 * 9/2009 Beardmore et al. ..... 123/456
2008/0156298 A1 * 7/2008 Brauneis et al. ..... 123/470
2008/0264390 A1 * 10/2008 Rottenwohrer et al. ..... 123/470

* cited by examiner

FUEL INJECTION SYSTEM FOR INTERNAL COMBUSTION ENGINE WITH INJECTOR ISOLATOR

CROSS REFERENCE TO RELATED APPLICATIONS

This application claims priority from U.S. Provisional patent application 61/144,513, Filed on Jan. 14, 2009, which is hereby incorporated by reference in its entirety.

BACKGROUND OF THE INVENTION

1. Field of the Invention

The present invention relates to an internal combustion engine having fuel injectors mounted within a cylinder head and spraying fuel into the engine's combustion chambers.

2. Related Art

Most spark ignited internal combustion engines used in automotive vehicles have employed fuel systems with either a carburetor, or more recently, multiple fuel injectors mounted in an intake manifold or within individual intake ports. Each of these systems provides fuel to the engine via the intake manifold. Although manifold/port mounted fuel injectors have generally been satisfactory, and indeed, a great improvement as compared with carburetor systems, automotive designers are increasingly moving to the use of direct fuel injection with spark ignited engines. With a direct injection system, fuel injectors are typically mounted through the fire deck of the engine's cylinder head and provide fuel directly into each of the engine's combustion chambers.

As used with spark ignition engines, direct injection has been found to be beneficial in terms of improved fuel economy, coupled with reduced exhaust emissions. Although direct injection has been used in many types of diesel engines for years, this new application of direct injection in gasoline engines intended for use in automotive vehicles has created a problem because the higher pressures utilized with direct injection have caused unwanted noise or "tick" while the engine is idling; under certain cases the tick may become more pronounced at high speeds and loads. This tick noise, resulting from injector needle impact, has not generally been a problem with most diesel engines, but has definitely proved to be an issue with direct-injected spark ignited engines, as well as with some diesel engines.

It would be desirable to provide a system allowing a low noise signature for gasoline and diesel direct injection fuel systems, while at the same time preserving the durability of fuel injectors. This presents a challenge, because if the injector's mounting is softened to the point where ticking noise is attenuated at idle, the corresponding movement of the injector within the cylinder head's injector pocket at high loads may cause adverse durability affects upon injector tip seals.

SUMMARY OF THE INVENTION

According to an aspect of the present invention, a fuel injection system for an internal combustion engine includes a cylinder head and an injector pocket formed in the cylinder head, with the pocket having a lower wall and an outer wall. A fuel injector is mounted within the injector pocket. An isolator is mounted between the injector and the lower wall of the injector pocket. The isolator includes an isolation ring having a generally annular base in contact with the lower wall and the outer wall. The isolation ring further includes an annular, cantilevered, inwardly extending load member having an upper contact surface extending above the annular base, with the annular load member being loaded elastically in bending during operation of the injector at idle, and with the annular base being column loaded compressively during higher-load operation of the injector.

According to another aspect of the present invention, an isolator may further include a pusher ring, interposed between the upper contact surface of the isolation ring load member and a lower portion of the fuel injector, with the pusher ring bearing upon only the load member during operation of the injector at idle, but with the pusher ring bearing upon the load member and upon the annular base during higher-load operation of the injector. The upper contact surface of the load member and the upper contact surface of the annular base define a static clearance gap which must be closed by force imposed by the injector and pusher ring upon the load member in order for both the load member and the upper portion of the annular base of the isolator to react to loads from the pusher ring and injector.

According to another aspect of the present invention, a method for mounting a fuel injector to a cylinder head of an internal combustion engine includes forming a pocket in a cylinder head with the pocket having a lower wall and an outer wall, and mounting a fuel injector within the pocket, with an isolator interposed between the injector and the lower wall of the injector pocket. The method further includes reacting to lower amplitude, axially directed injector forces with an elastic load member incorporated within the isolator, and reacting to higher amplitude, axially directed injector forces with a column loaded portion of the isolator.

According to an aspect of the invention, the elastic load member comprises an annular, cantilevered, inwardly extending load member, as described above, and having an upper contact surface extending above an annular base seated against the lower wall of the injector pocket.

It is an advantage of a fuel injection system according to the present invention that objectionable ticking noise which is particularly prevalent in engines having direct cylinder injectors, will be avoided, while at the same time protecting injector tip seals from harm which could otherwise occur as a result of a compliant and quiet mounting system.

It is an advantage of a system according to the present invention that a dual rate load deflection curve is established for the response of the injector mount to the pressures imposed upon the injector while the injector is operating at any regime from idle to full output.

It is yet another advantage of a fuel injection system according to the present invention that the isolator used in the present system is readily tunable to accommodate changes in engine operating parameters.

Other advantages, as well as features of the present invention, will become apparent to the reader of this specification.

DETAILED DESCRIPTION OF THE PREFERRED EMBODIMENTS

Figure 1:
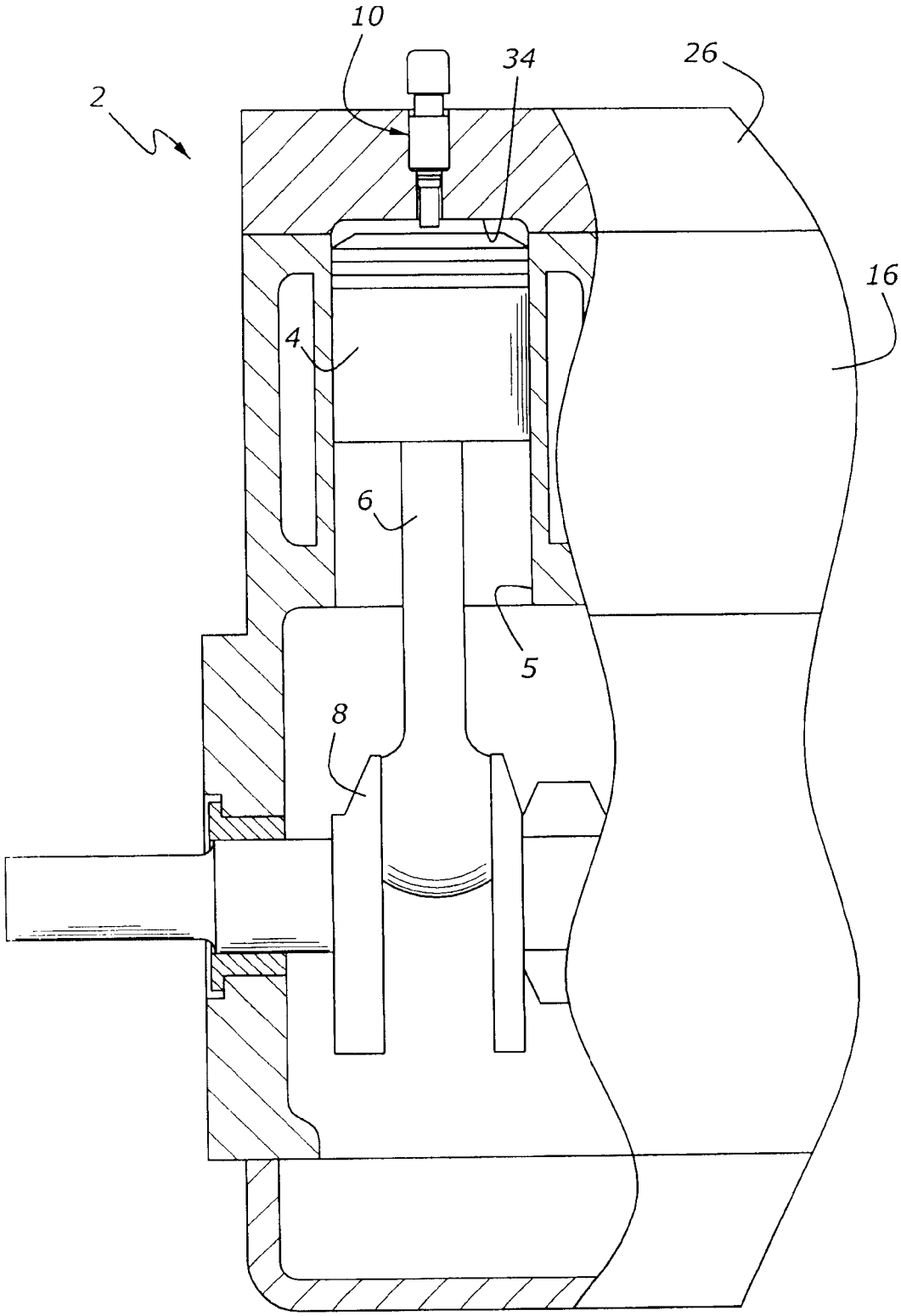
FIG. 1 is a schematic representation of a portion of an engine having a fuel injection system according to the present invention.

FIG. 1 illustrates an engine, 2, having a crankshaft, 8, with a piston, 4, and a connecting rod, 6, attached thereto, for reciprocating motion within a cylinder, 5, formed in a cylinder block, 16. A cylinder head, 26, is mounted at the top of engine 2. A fuel injector, 10, is mounted through cylinder head 26 so as to supply fuel directly to the combustion chamber defined by cylinder head 26 and piston 4.

Figure 2:
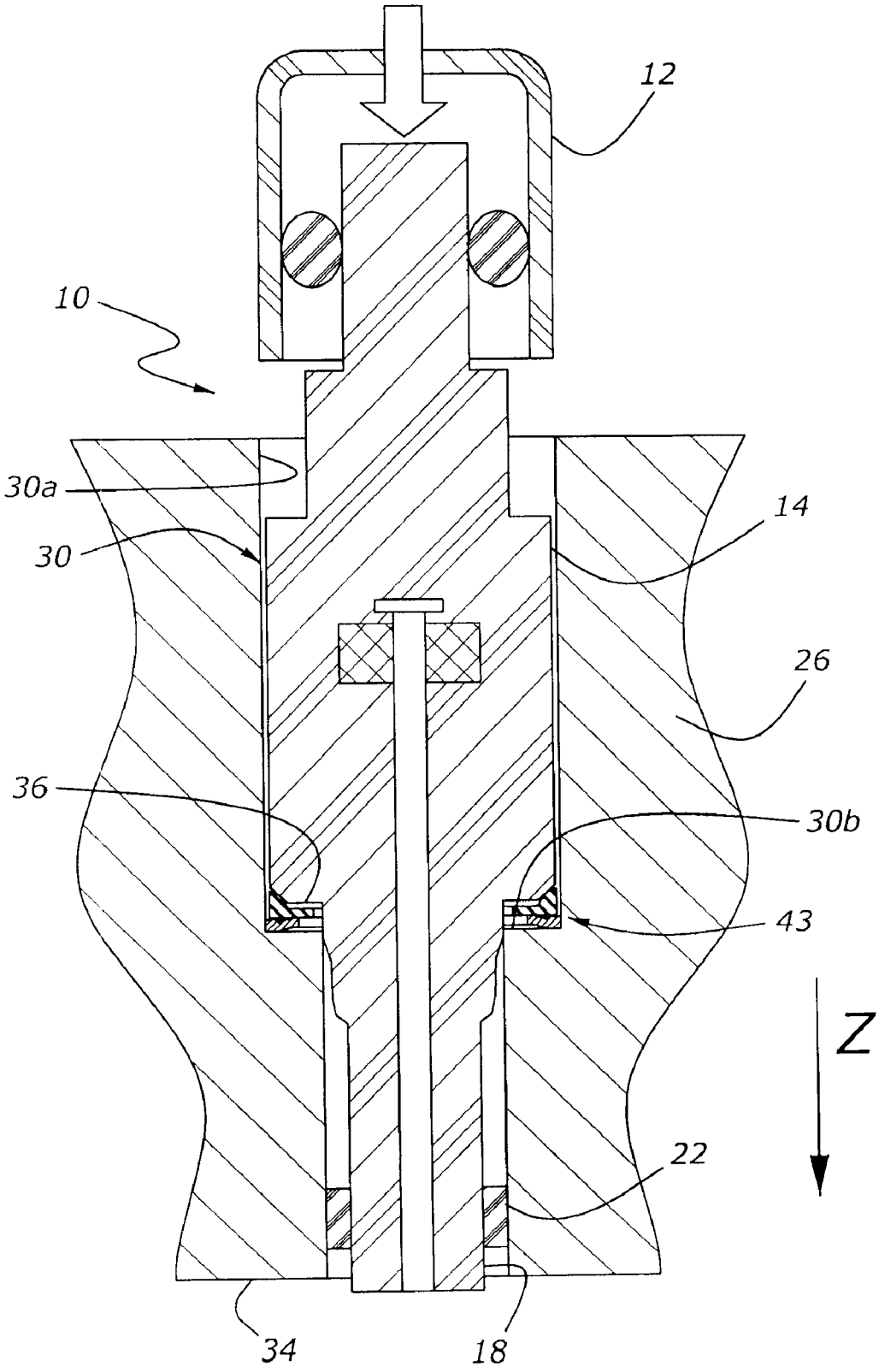
FIG. 2 is a partially schematic representation of an injector mounted in a cylinder head according to an aspect of the present invention.

FIG. 2 is a partially schematic representation of a fuel injection system having an injector isolator according to an aspect of the present invention. Fuel injector 10 receives fuel through a supply system including a fuel rail cap, 12, which is mounted to the top of injector 10. Injector 10 has a generally cylindrical outer body, 14, which is mounted within an injector pocket, 30, formed in cylinder head, 26. Injector 10 has a tip, 18, with a tip seal, 22, which is preferably formed from a plastics material such as polytetrafluoroethylene. Injector tip 18 extends through fire deck 34 of cylinder head 26. Because fire deck 34 and the upper surface of piston 4 configure a combustion chamber, injector 10 is deemed to be a direct injector. Tip seal integrity is important because the tip seal prevents high pressure gases from leaking from the combustion chamber past the injector.

Injector pocket 30 has an outer wall, 30*a*, which is generally cylindrical, and a lower wall, 30*b*, which is generally annular. Injector 10 is mounted within injector pocket 30 including surfaces 30*a* and 30*b*, with an isolator, 43, being mounted between injector 10 and lower wall 30*b* of injector pocket 30.

Figure 3:
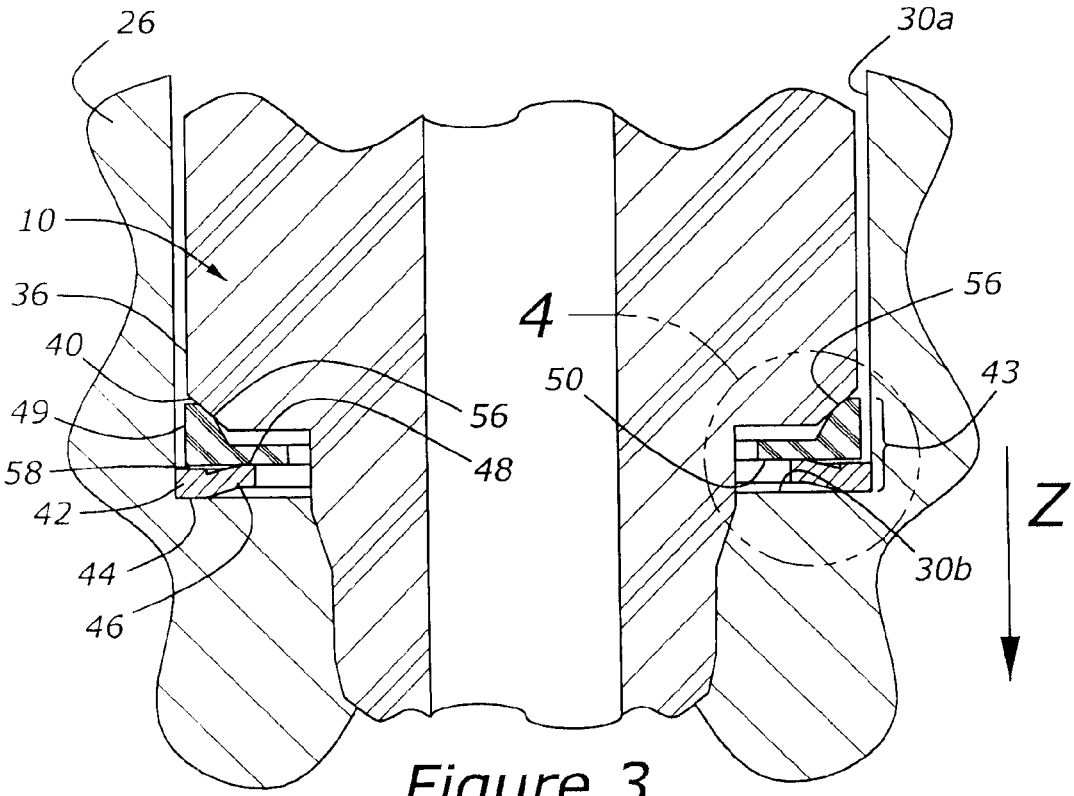
FIG. 3 shows a portion of the injector of FIG. 2 with specificity related to the isolator portion of the injector mounting system.
Figure 3A:
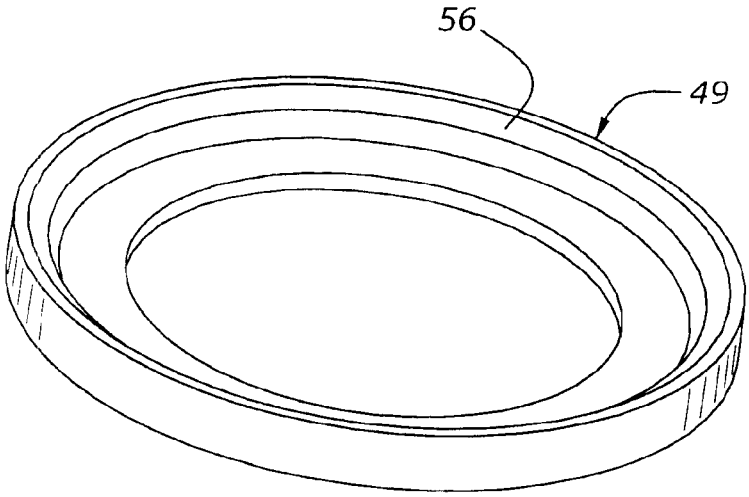
FIGS. 3A and 3B illustrate individual components of a two-piece isolation system according to the present invention.
Figure 3B:
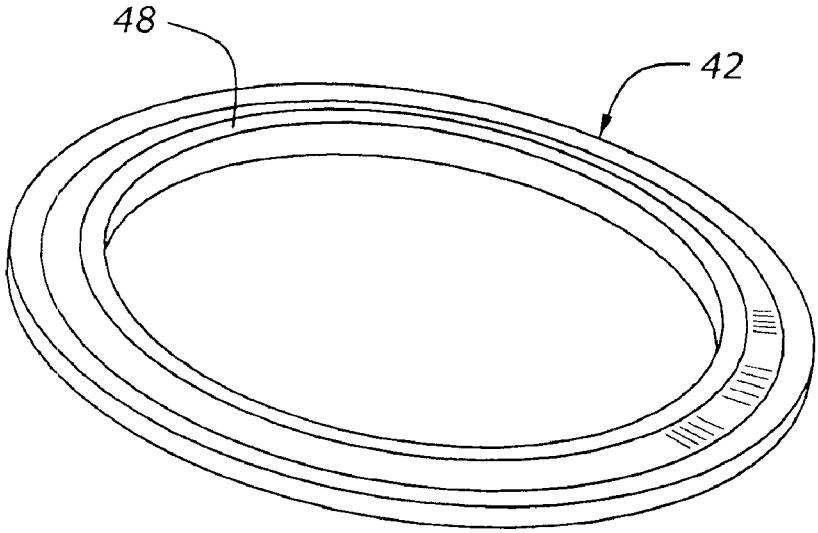

FIGS. 3, 3A, 3B, 4 and 5 illustrate various details of isolator 43 and show interaction with injector 10 and with injector pocket 30, including surfaces 30*a* and 30*b*. According to an aspect of the present invention, isolator 43 includes an isolation ring, 42, and a pusher ring, 49. Isolation ring 42 has a generally annular base, 44, which is in contact with lower wall 30*b* of injector pocket 30. Annular load member 46 is cantilevered from base 44 and extends inwardly from base 44. Load member 46 has an upper contact surface, 48, which extends above annular base 44. FIG. 3A is a perspective view of a pusher ring 49, and FIG. 3B is a perspective view of isolation ring 42. Pusher ring 49 is interposed between upper contact surface 48 of primary ring 42 and a wedge-shaped lower portion, 40, of injector 10. Pusher ring 49 has an injector contact surface, 56, which interacts with lower portion 40 of injector 10. Pusher ring 49 also has a lower contact surface, 50, which contacts upper contact surface 48 of load member 46, causing load member 46 to deflect downward, so as to close axial clearance gap 58 (FIG. 4) in response to axially directed force from injector 10. This force is applied in the Z direction noted in the various Figures.

Figure 4:
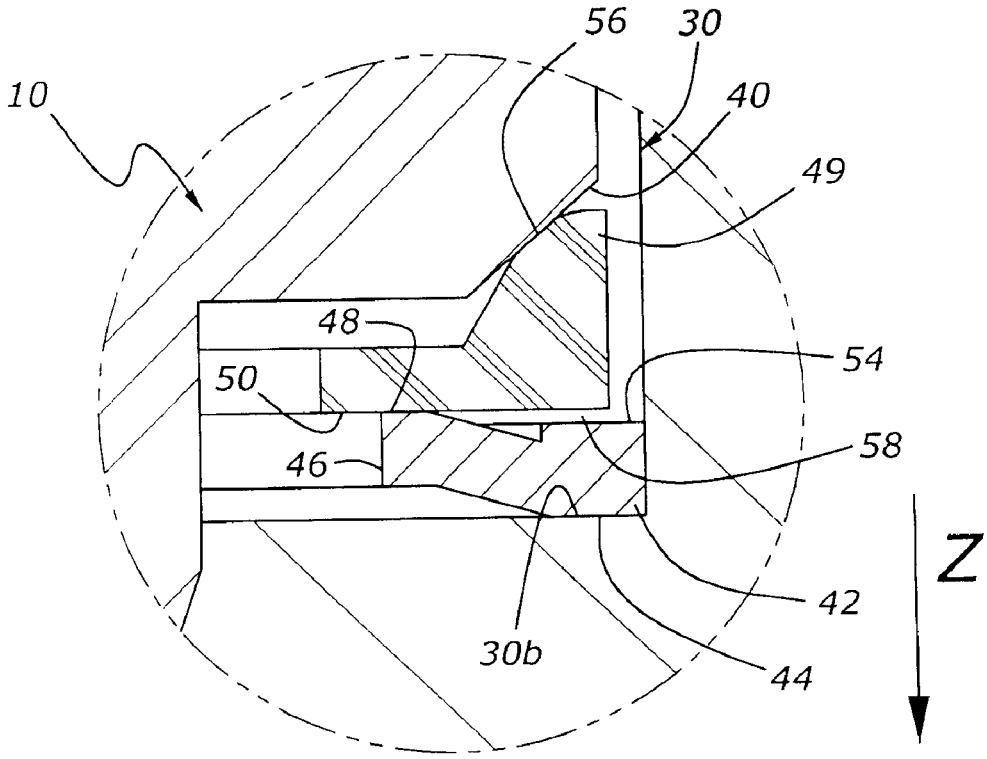
FIG. 4 is an enlargement of a portion of FIG. 3, showing an isolation system in greater detail.
Figure 5:
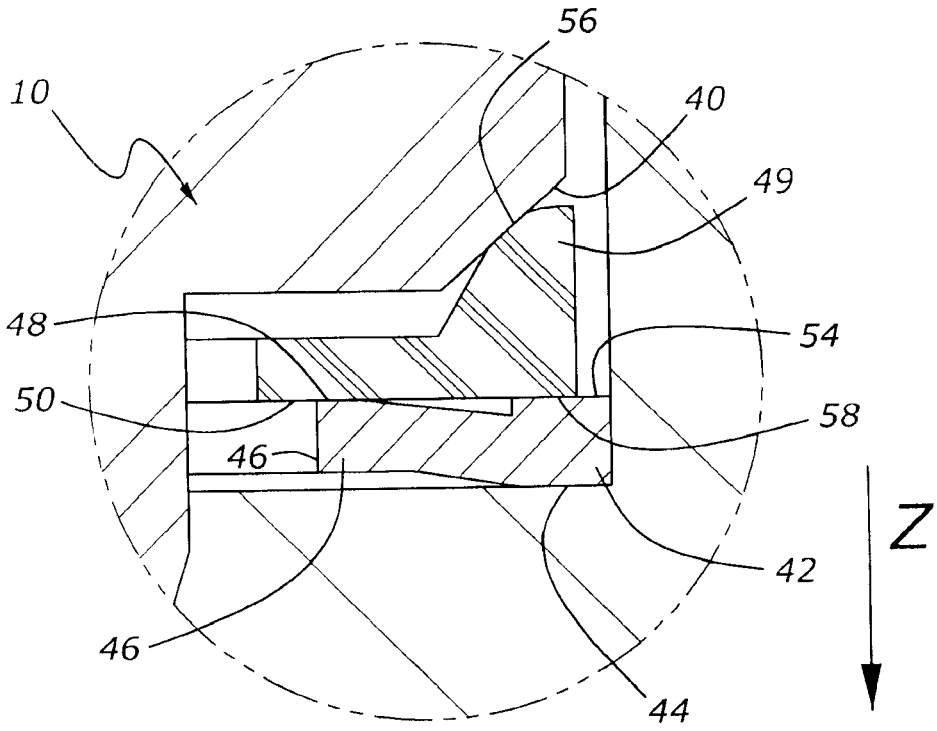
FIG. 5 shows the isolation system of FIG. 4 in a compressed state corresponding to high load operation.

As best seen in FIG. 4, upper contact surface 48 of isolation ring 42 and lower contact surface 50 of pusher ring 49 define a static, axial clearance gap, 58 extending between surfaces 54 and 50. Gap 58, which exists during idle and lower power operation of engine 2, allows pusher ring 49 to bear upon only annular load member 46 of isolation ring 42. In this manner, vibration of injector 10 is results in elastic bending or loading of load member 46. This compliance prevents unwanted injector tick noise at idle and lower power operation. On the other hand, during higher power operation, shown in FIG. 5, load member 46 is deformed elastically by an amount sufficient to close axial clearance gap 58 to a point at which annular base 44 of isolation ring 42 is subjected to column loading by surface 50 of pusher ring 49. In effect, pusher ring 49 and isolation ring 42 are stacked solid, and further increases in axially directed force will cause little change in the deflection of ring 42 and pusher 49. In this manner, unwanted movement of injector 10, and particularly, unwanted motion of injector tip 18, will be prevented.

Figure 6:
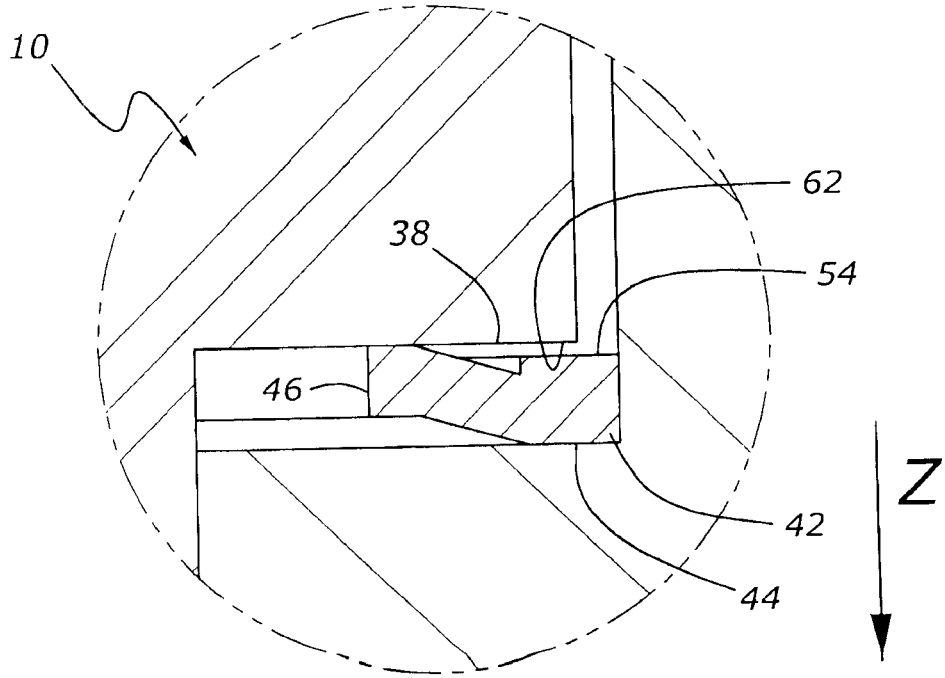
FIG. 6 illustrates an alternative embodiment in which the isolation device includes a single isolation ring.
Figure 7:
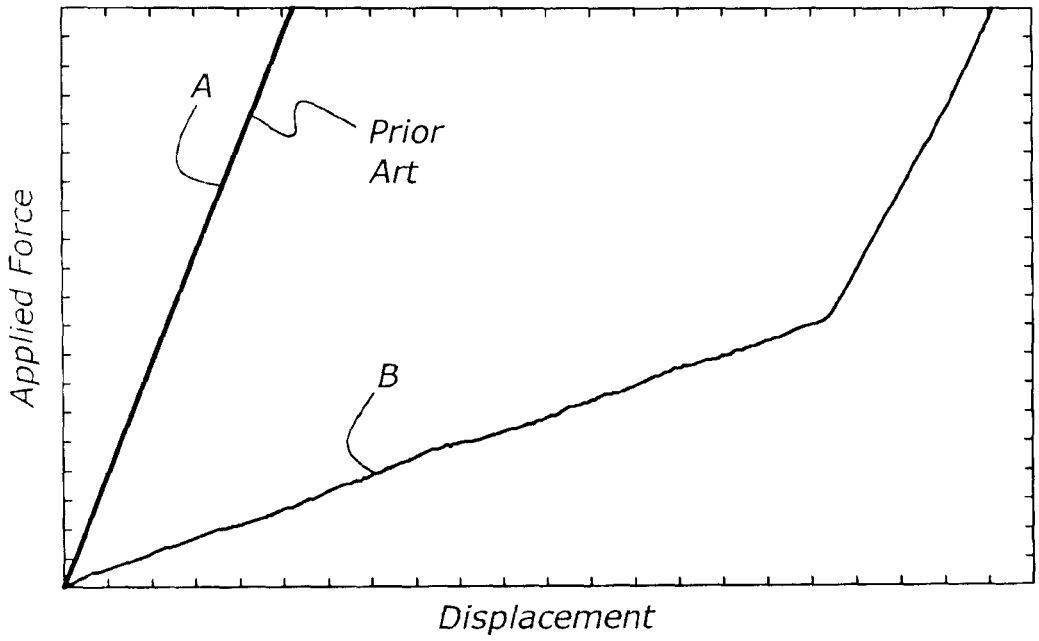
FIG. 7 shows a force/displacement curve for both a prior art isolator and a device according to the present invention.

One of the effects of the present invention is depicted graphically in FIG. 7, which includes two plots of force and resultant axial displacement for an injector. The axial, or Z, direction is shown in FIGS. 2, 3, 4, 5, and 6. Curve A in FIG. 7 shows a very aggressive force displacement curve typical of a conventional steel isolator ring. This ring will exhibit undesired tick noise because the applied force builds too rapidly with displacement.

Curve B in FIG. 7 shows the dual rate force/displacement trend of the present inventive isolator. For lower force levels imposed by injector 10 upon the isolator, increasing, but controlled displacement is permitted with a relatively soft force/displacement characteristic. However, when a tunable force threshold is reached, load member 46 will deform elastically to the degree that surfaces 50 and 54 will abut, or stack solid, which will have the effect of greatly increasing the force/displacement characteristic, or stiffness, of isolator 43, thereby protecting the integrity of injector tip seal 22. As noted above, this condition is depicted in FIG. 5.

FIG. 6 illustrates an embodiment of the present invention in which injector 10 has a blunt end, 38, formed thereupon, with end 38 interacting directly with isolation ring 42. The embodiment of FIG. 6 operates in much the same manner as the embodiment shown in the previous figures, it being understood that upper annular surface 54 of annular base 44 and the lowermost portion of squared-off injector base 38 define an annular gap, 62 which when closed, will mean that not only load member 46, but also annular portion 44, will react against the axial forces imposed upon isolation member 42 in the illustrated Z direction. FIG. 6 shows an injector operating either at idle or another low power regime.

In a preferred embodiment, pusher ring 49 is configured from steel, for strength reasons. Isolation ring 42 is preferably configured from a dissimilar material, such as aluminum or a plastics material, such as polytetrafluoroethylene. Contructing rings 42 and 49 from dissimilar materials provides beneficial friction damping between the two rings.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A fuel injection system for an internal combustion engine, comprising:

a cylinder head;

an injector pocket formed in said cylinder head, with said pocket having a lower wall and an outer wall;

a fuel injector mounted within said injector pocket; and an isolator mounted between said injector and said lower wall of said injector pocket, with said isolator comprising an isolation ring having a generally annular base in contact with said lower wall and said outer wall, and further comprising an annular, cantilevered, inwardly extending load member having an upper contact surface extending above said annular base, with said annular load member being loaded elastically in bending during operation of the injector at idle, and with the annular base being column loaded compressively during higher-load operation of the injector.

2. A fuel injection system according to claim 1, wherein said isolator further comprises a pusher ring, interposed between the upper contact surface of said load member and a lower portion of said injector, with said pusher ring bearing upon only said load member during operation of the injector at idle, and with the pusher ring bearing upon said load member and upon said annular base during higher-load operation of the injector.

3. A fuel injection system according to claim 1, wherein the upper contact surface of said load member and said upper surface of said annular base define a static clearance gap which must be closed by force imposed by said injector upon the load member in order for the isolator to react with both said load member and said upper portion of said annular base.

4. A fuel injection system according to claim 2, wherein said injector subjects said isolation ring and said pusher ring to column loading when a said static clearance gap extending between the isolator and the pusher ring is closed.

5. A fuel injection system according to claim 1, further comprising a gas seal mounted to a tip portion of said injector.

6. A fuel injection system according to claim 5, wherein said gas seal comprises an annulus formed from a plastics material.

7. A fuel injection system according to claim 5, wherein said gas seal comprises an annulus formed from a fluorocarbon material.

8. A fuel injection system according to claim 2, wherein said pusher ring bears upon an upper portion of said annular base during higher-load operation of the injector.

9. A fuel injection system according to claim 1, wherein said fuel injector sprays fuel directly into a combustion chamber configured by a fire deck of said cylinder head and the uppermost portion of a piston housed reciprocably below the cylinder head.

10. A method for mounting a fuel injector to a cylinder head of an internal combustion engine, comprising:

forming a pocket in a cylinder head, with said pocket having a lower wall and an outer wall;

mounting a fuel injector within said injector pocket, with an isolator interposed between the injector and the lower wall of said injector pocket;

reacting to lower amplitude, axially directed injector forces with an elastic load member incorporated within said isolator; and reacting to higher amplitude, axially directed injector forces with a column-loaded portion of said isolator.

11. A method according to claim 10, wherein said elastic load member comprises an annular, cantilevered, inwardly extending load member having an upper contact surface extending above an annular base seated against the lower wall of the injector pocket.

12. A method according to claim 11, wherein said annular base comprises said column-loaded portion of said isolator.

13. A method according to claim 10, further comprising mounting a pusher ring about a lower portion of said injector between the injector and the isolator, such that the isolator comprises at least two pieces.

14. An internal combustion engine, comprising:

a cylinder block;

a crankshaft housed within the cylinder block;

a piston and connecting rod mounted upon said crankshaft for reciprocation within said cylinder block;

a cylinder head mounted to said cylinder block;

an injector pocket formed in said cylinder head, with said pocket having a lower wall and an outer wall;

a fuel injector mounted within said injector pocket and configured to spray directly into a combustion chamber defined by said cylinder head and said piston; and an isolator mounted between said injector and said lower wall of said injector pocket, with said isolator comprising:

an isolation ring having a generally annular base in contact with said lower wall and said outer wall, and further comprising an annular, cantilevered, inwardly extending load member having an upper contact surface extending above said annular base; and a pusher ring, interposed between the upper contact surface of said load member and a lower portion of said injector, with said ring bearing upon only said load member during operation of the injector at idle, and with the pusher ring bearing upon said load member and an upper portion of said annular base during higher-load operation of the injector, whereby an axially directed force/deflection characteristic of said isolator will have a lower rate for smaller displacements of the injector and a higher rate for larger displacements of the injector.

15. An internal combustion engine according to claim 14, further comprising a gas seal mounted upon a tip portion of the injector, such that the gas seal is subject to compressive forces resulting from vibration of the injector.

* * * * *